United States Patent [19]

Bouthors et al.

[11] 4,427,156

[45] Jan. 24, 1984

[54] ELECTROMAGNETICALLY ACTUATED BALL-TYPE INJECTOR

[75] Inventors: Pierre Bouthors, Croissy sur Seine; Jacques Lecomte, Montesson, both of France

[73] Assignee: Regie Nationale des Usines Renault, Boulogne-Billancourt, France

[21] Appl. No.: 315,906

[22] Filed: Oct. 28, 1981

[30] Foreign Application Priority Data

Oct. 29, 1980 [FR] France ..... 80 23105

[51] Int. Cl.[3] ..... B05B 1/34

[52] U.S. Cl. ..... 239/488; 239/585

[58] Field of Search ..... 239/585, 584, 487, 488, 239/494, 496, 497; 251/139, 140, 141

[56] References Cited

U.S. PATENT DOCUMENTS

| | | | |
|---|---|---|---|
| 1,008,119 | 11/1911 | Dahl | 239/496 |
| 2,974,881 | 3/1961 | Garday | 239/584 X |
| 3,731,880 | 5/1973 | Williams | 239/585 |
| 3,865,312 | 2/1975 | Lombard et al. | 239/585 |
| 4,186,883 | 2/1980 | Robling | 239/491 |
| 4,346,847 | 8/1982 | Rissi | 239/585 |

FOREIGN PATENT DOCUMENTS

| | | | |
|---|---|---|---|
| 2108528 | 4/1972 | France . | |
| 2166735 | 7/1973 | France . | |
| 2072306 | 9/1981 | United Kingdom | 251/139 |

*Primary Examiner*—John J. Love
*Assistant Examiner*—Mary F. McCarthy
*Attorney, Agent, or Firm*—Oblon, Fisher, Spivak, McClelland & Maier

[57] ABSTRACT

An electromagnetically actuated injector, for the injection of fluid in internal combustion engines in particular, comprises a casing, a core located within the casing, an actuating coil surrounding the core, a fluid inlet passage, a chamber between the core and a cover. The injector contains a ball which cooperates with a seat to close the injection passage formed in the cover, said ball being attracted by the actuating coil against an elastic system mounted in front of the core and which urges the ball against its seat. The injector includes a disk interposed between the core and the ball, the disk surface facing the ball being coated with a thin layer of nonmagnetic material, a seat with a circular working surface, a funnel-shaped nozzle for automatic fluid-flow regulation, and an injection tip provided with spiral inclines to create a cone-shaped spray at the outlet of the injection nozzle. Application is to fuel injection in the internal combustion engines of automotive vehicles.

8 Claims, 8 Drawing Figures

ELECTROMAGNETICALLY ACTUATED BALL-TYPE INJECTOR

BACKGROUND OF THE INVENTION

1. Field of the Invention

This invention concerns an electromagnetically actuated ball-type injector, intended for the injection of fluid, expecially fuel in internal combustion engines.

2. Description of the Prior Art

An injector of this type has been previously described in an earlier French Pat. No. 2166734 and its supplement No. 2211049 filed by the present application.

They describe in particular an electromagnetically actuated injector comprising a casing within which is located a core including a fluid inlet passage, an actuating coil surrounding the core, a chamber between the cover and the core and which contains a ball to close the injection passage formed in the cover, said ball being attracted in the direction which opens the injection passage by the magnetic field created by the actuating coil against an elastic system which urges the ball back against its seat.

In this embodiment, the end of the core must be machined so as to locate in it, first, the elastic system which may be a simple coil spring, and second, a fitted part made of a nonmagnetic material to keep the ball from adhering to the core because of residual magnetism. This machining does not pose any particular problems, but substantially increases the manufacturing costs of the injector.

Moreover, despite the return force of the spring, tightness of the ball on its seat is not always achieved with a satisfactory degree of efficiency.

Finally, it may happen that turbulence associated with cavitation phenomena occurs, as is customary beneath the seat of the injector when the fluid reaches a temperature at which is begins to vaporize. The flow in the injection conduit is then altered as a function of temperature.

SUMMARY OF THE INVENTION

The aim of the present invention is to avoid the major drawbacks noted above and to produce a perfected ball-type injector which is easier and more economical to manufacture while at the same time improving its functional characteristics, particularly as regards flow and tightness.

This result is obtained basically by interposing a solid disk made of an extremely hard magnetic material between the core and the ball, with the disk surface facing the ball being coated with a thin nonmagnetic layer, by having a perfectly circular working surface over the contact area of the seat with the ball, and by adding, inside the seat, a self-regulating flow nozzle of a predetermined outline.

Manufacture of the disk is much easier and more economical than machining the ends of the cores as in prior art. The return spring hence rests on a flange of the disk, while the latter is in direct contact with a smooth surface of the soft iron core.

The seat, also made of an extremely hard material, may be machined by various procedures so as to have circular working surface which ensures perfect tightness with the ball. Preferably, this working surface is achieved by stamping the seat directly with a ball having the same size characteristics.

The nozzle is funnel-shaped, with an outline determined empirically so as to make it possible for the fluid to flow without coming off the walls regardless of temperature, which eliminates turbulence and ensures a constant and automatically regulated flow.

BRIEF DESCRIPTION OF THE DRAWINGS

Other advantages and particular features will emerge from the following description of several types and variants of embodiments of the invention, with reference to the attached drawings, in which.

DETAILED DESCRIPTION OF THE PREFERRED EMBODIMENTS

Figure 1:
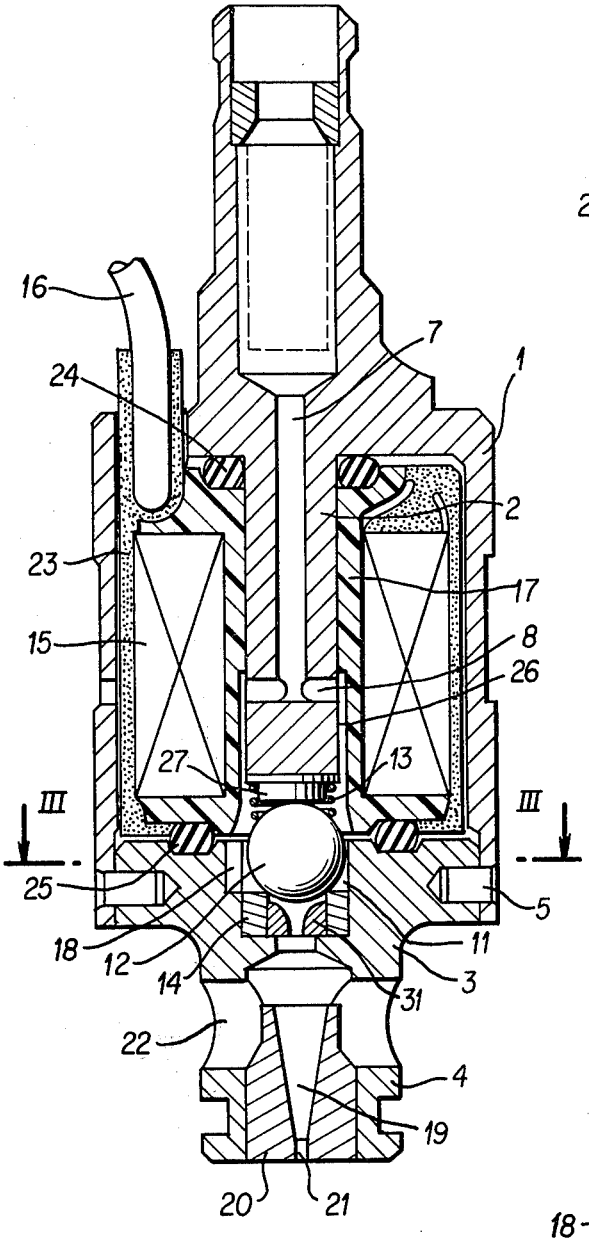
FIG. 1 represents a cross-section of a core feed injector equipped with certain improvements according to the invention.

FIG. 1 shows an injector of the type previously described of the earlier patents cited above which consists in a container of a magnetic material of which a first part forms the casing 1, a second part forms the core 2 of an electromagnet, and a third part forms the cover 3 ended by the injection tip 4. The core may be made of the same material as the casing (FIG. 1), with the cover 3 being attached firmly to the casing by any known means of assembly, for example cotter pins 5, or else the cover may be directly fitted to the core by any means of assembly, for example by screw threading 6 (FIG. 4), the cover 3 then being an integral part of the casing 1.

In the embodiment of FIG. 1, the fluid is fed through passages 7, 8 passing through the core whereas, in FIG. 4, as the core 2 is solid, the fluid feed is lateral at the level of the injector tip 4, through a passage 9 passing through the intake manifold 10 of the internal combustion engine, for reasons which will be explained below.

A chamber 11 is formed within the casing 3 for the placement of a valve made up of a ball 12 of a magnetic material urged by an elastic system such as a coil spring 13 against an annular seat 14 made of a nonmagnetic material.

Figure 3:
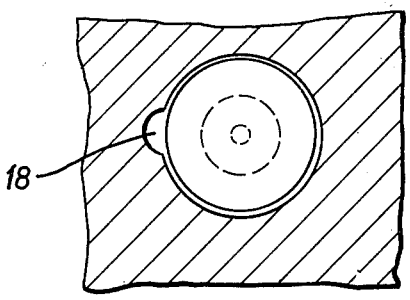
FIG. 3 is a partial cross section along line III of FIG. 1.

When actuated by the magnetic field created by a coil 15 fed with electrical current by a supply wire 16 and wrapped about a support or frame 17 preferably made of a molded synthetic material, the ball 12 is pushed against the end of the core 2, in a direction opposing the force of the return spring 13, and the fluid flows initially through a passage 18 formed in the housing (FIG. 3), then across the seat 14 and through the injection passage 19 which goes through the tip and ends in an injection nozzle 20 of a shape and with characteristics suited to the function of the injector, through which pass one or several fluid atomizing orifices 21, perhaps with a channel for exposure to atmospheric pressure (FIG. 1).

The electrical circuit is sealed off from the fluid circuit by a known method, first, by using a synthetic wrapping 23 around the coil, and second, by interposing seals 24, 25 compressed between the frame of the coil and the casing, core or cover depending on the mounting method selected.

Since the core penetrates inside the coil framework, in the case of fluid feed through the core, the circulation of the fluid is facilitated by an annular conduit 26 resulting from the difference between the diameters of the end of the core 2 and the enlarged bore of the frame 17.

Figure 2:
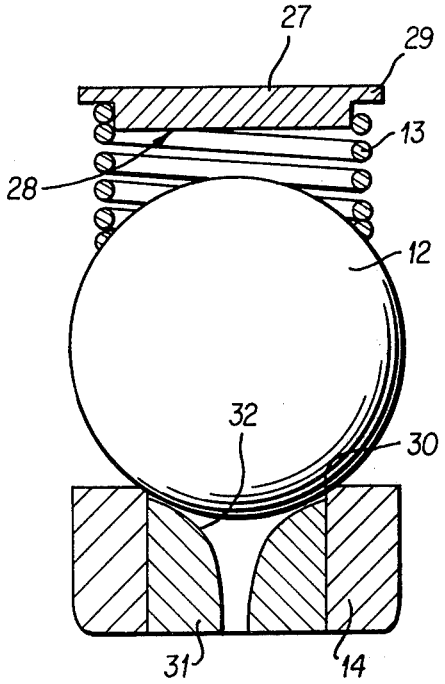
FIG. 2 is an enlarged view of the shutoff ball on its seat.

In accordance with a first characteristic of the invention (FIG. 2), a solid disk 27 of an extremely hard magnetic material is interposed between the core 2 of soft iron and the ball 12, with the surface 28 of the disk facing the ball being coated with a thin layer of nonmagnetic metal so as to avoid adherence to the ball as the result of residual magnetism.

The magnetic layer may, for example, be a layer of electrolytically deposited nickel with a thickness preferably of less than 0.01 mm. The extreme hardness of the steel used for the disk makes it possible to avoid the pitting caused by the successive impacts of the ball.

The return spring 13 is attached on a flange 29 of the disk, and the latter presses directly against the plane surface of the end of the core 2.

In accordance with another characteristic of the invention, the annular seat 14, likewise made of an extremely hard nonmagnetic material, has a circular working surface 30 adapted to the size characteristics of the ball, a working surface which may be produced by any known machining method but preferably by cold stamping. A perfect seal is thus obtained when the injection passage is closed by the ball.

In accordance with another characteristic, the seat 14 houses an automatic fluid flow regulation noozle 31, which as a surface outline 32 of a funnel, whose empirically determined geometry may be imparted by any known mechanical or electromechanical machining procedures, with finishing preferably by means of calipering-stamping. The nozzle 31 may be fitted within the seat 14, and in this case, the materials used for the seat and the nozzle may be different. For example, brass or bronze, which are easier to work, may be used for the nozzle while the seat is again made of hard steel.

The nozzle may instead be made unitary with, and of the same metal as, the seat.

As noted, the outline 32 of the nozzle makes it possible to regulate the fluid flow, so as to make it virtually independent of the temperature of the injector. Indeed, it is known that turbulence occurs beneath the seat 14 of the injector when the fluid achieves a temperature at which it begins to vaporize. The shape of the nozzle 31 keeps streams of fluid from separating from the walls and thus eliminates the phenomenon of cavitation.

Figure 4:
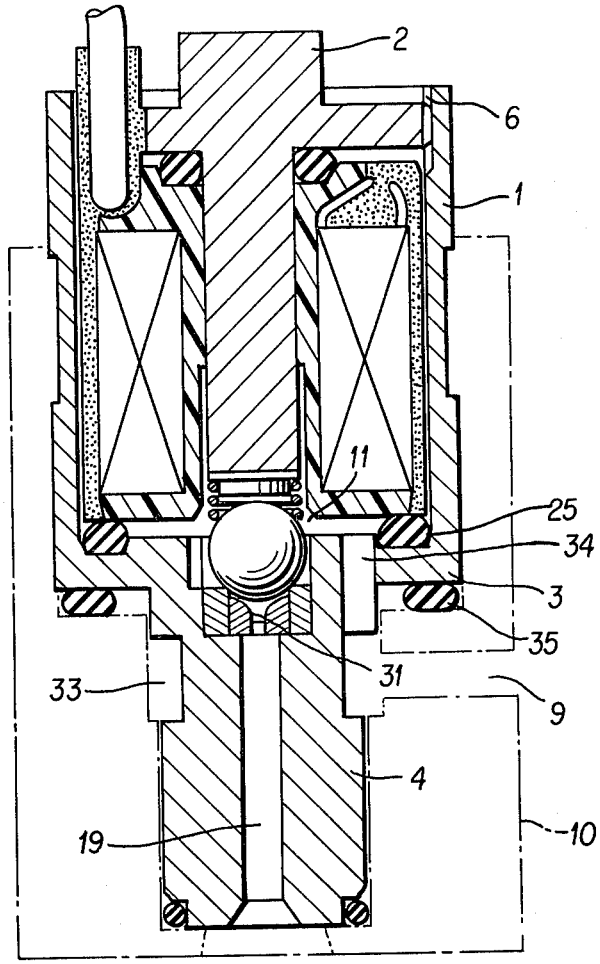
FIG. 4 is a second embodiment featuring lateral feed through the tip of the injector.

In the variant of FIG. 4 where the injector is fed from the side, in addition to the presence of the automatic regulating nozzle 31, it is posible to minimize temperature variations even further by circulating the feed fluid from passage 9 around the injector tip 4 at the outlet end of the nozzle 31 by circulating the feed fluid through an annular chamber 33 between the intake manifold 10 and the tip.

This feed fluid then is connected with the chamber 11 for the valve via a channel 34 through the cover, with seal 25 being moved toward the outside of the injector's axis of symmetry and another seal 35 being interposed between the cover and the intake manifold.

Figure 6:
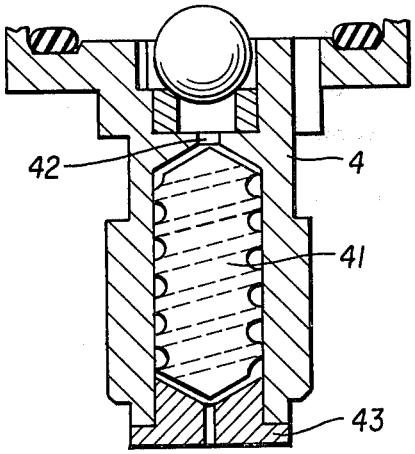
FIGS. 5 and 6 represent variant injection tips with spiral inclines making it possible to obtain cone-shaped sprays.
Figure 5:
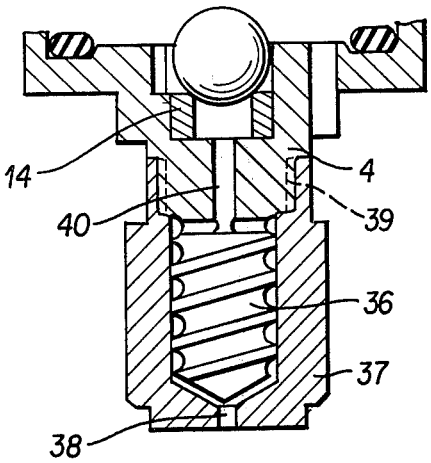

FIGS. 5 and 6 illustrate variant embodiments of the injector tip in FIG. 4, whereby it is possible to achieve the vaporization of the fluid at the outlet point in a cone-shaped spray. In this case, the nozzle 31 inside the seat serves no purpose and may be eliminated.

In FIG. 5, the tip 4 is extended by a threaded socket 36, the threaded socket including spiral grooves and being placed inside a nozzle with a conical interior bottom axially penetrated by an injection orifice 38. The end of the socket is likewise conical. The nozzle may be attached to the tip by any appropriate means, for example by screw threading 39.

The tip is pierced below the seat 14 by an inverted T-shaped passage 40 whose lower end opens into the spiral grooves so that the fluid is guided in a spiral movement all around the socket until it emerges in a cone-shaped spray whose peak angle may be regulated by simply modifying the geometry and relative positions of the nozzle 37 and the socket 36.

In FIG. 6, the threaded socket is replaced by an independent part 41 fitted inside a hollow tip 4, communicating with the valve via passage 42 and held in place by the pressure of a conical nozzle 43 fitted to the end of the tip.

However, the variants shown in FIGS. 5 and 6 are best suited a continuous functioning of the injector in view of the amount of fluid in movement in the spiral inclines.

Figure 7:
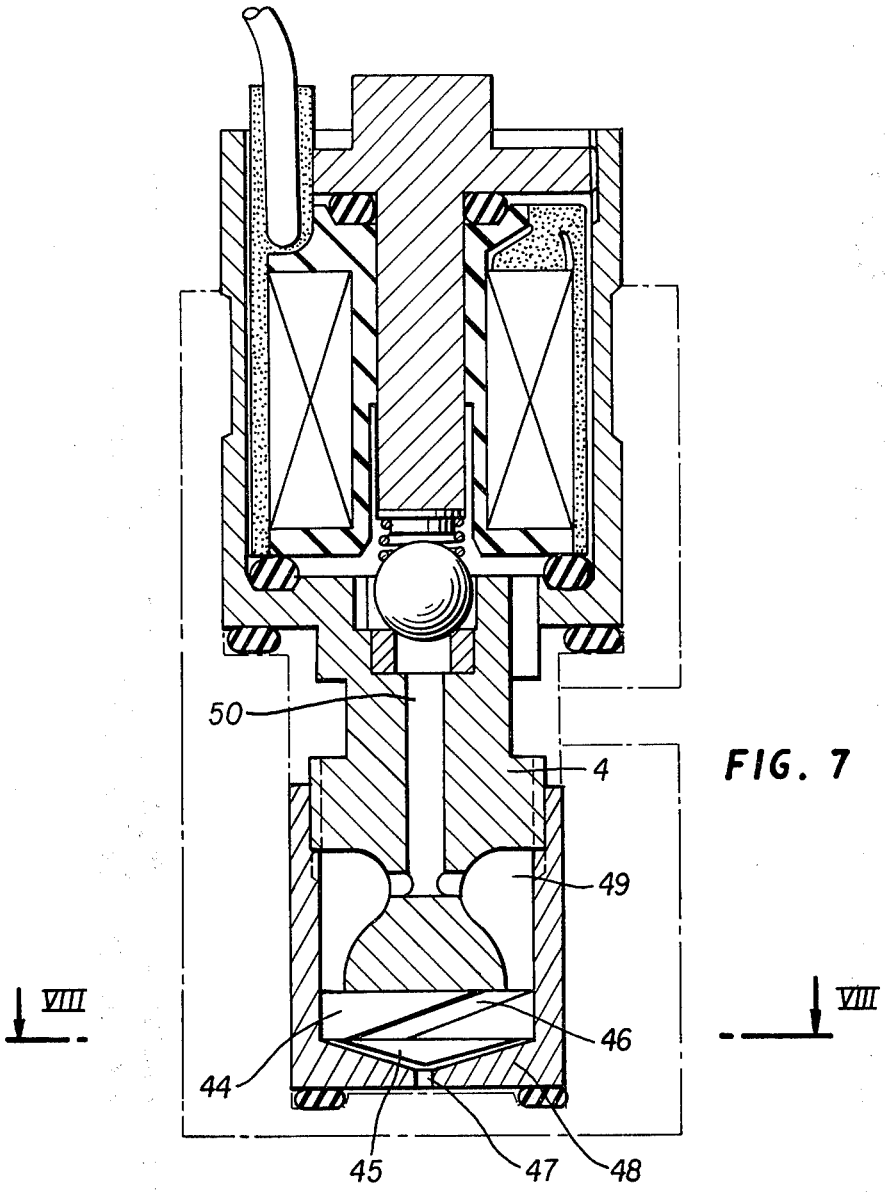
FIG. 7 is another variant injection tip with a grooved washer.
Figure 8:
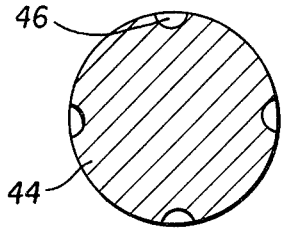
FIG. 8 is a cross section of the washer along line VIII of FIG. 7.

For operations with pulses of fluid, it is preferable to use the variant embodiment of FIGS. 7 and 8 in which the threaded socket is replaced by a solid washer 44 with a conical bottom 45 having, on its peiphery, one or several diagonal grooves 46 connecting the two ends of the washer and connecting the injection hole 47 of the conical nozzle assembly 48, fitted to the tip 4 in an adjustable manner, and a fluid distribution chamber 49 formed in the solid end of the tip 4. The tip 4 thus rests against the upper surface of the washer 44 which is held by the nozzle assembly 48. The tip 4 is pierced by a T-shaped injection passage which feeds the distribution chamber 49 from the seat of the valve.

This variant also provides a cone-shaped spray, but in this case the volume below the spiral inclines is less than in the preceding case, which promotes the rotation of the fluid. In addition to this advantage, it should be noted that manufacture of the washers from any material whatsoever is very easy and hence not costly.

Obviously, numerous modifications and variations of the present invention are posible in light of the above teachings. It is therefore to be understood that within the scope of the appended claims, the invention may be practiced otherwise than as specifically described herein.

What is claimed as new and desired to be secured by Letters Patent of the United States is:

1. An electromagnetically actuated injector for the injection of fluid in internal combustion engines, comprising:

a casing;

a core centrally located in said casing;

an actuating coil surrounding said core;

a cover enclosing a portion of said casing;

a first chamber defined between said core and said cover;

fluid inlet means for providing fluid to said first chamber;

an injection passage formed in said cover and extending into said first chamber;

a seat at the junction of said injection passage and said first chamber;

a ball in said first chamber and movable between a first position in which said ball cooperates with said seat to close said injection passage and a second position;

a solid disc of hard magnetic material positioned in said first chamber between said ball and said core, said disc having a flange and a surface facing said ball, said surface being coated with a thin layer of nonmagnetic material; and spring means extending between said ball and said flange for elastically biasing said ball into said first position and for elastically biasing said solid disc in contact with said core.

2. The injector of claim 1 wherein said seat comprises a stamped circular working surface and is made of a hard nonmagnetic metal.

3. The injector of claims 1 or 2 wherein said seat includes an automatic fluid flow regulating nozzle, the outline of which is funnel shaped and finished by calipering stamping, said nozzle being positioned so as not to be contacted by said ball.

4. The injector of claim 3 wherein said seat and said nozzle are formed in one body.

5. The injector of claims 1 or 2 wherein said injector is mountable on an engine manifold, said injector including:

a tip formed from a portion of said cover extending into said manifold;

an unobstructed annular chamber defined by said cover, said tip and said manifold, said annular chamber surrounding said tip, wherein said fluid inlet is connected between said annular chamber and said first chamber, whereby the temperature of said tip is maintained constant.

6. The injector of claim 5 wherein said tip has a spiral configuration about the longitudinal axis thereof, and wherein said injector includes a hollow nozzle member having a nozzle in a conical interior bottom surface thereof and a top end connected to said cover, whereby said nozzle encloses said tip and whereby said spiral surface of said tip promotes the vaporization in a conical spray of the fluid exiting said nozzle.

7. The injector of claim 5 wherein said tip is hollow, including a socket fitted in said hollow of said tip and having a spiral configuration about the longitudinal axis thereof, and an injector nozzle closing the distal end of said hollow tip.

8. The injector of claim 5 further comprising:

a hollow nozzle element fitted to said tip and enclosing the distal end of said tip;

a solid washer pressed between said distal end of said tip and said nozzle element and having a conical bottom; and at least two diagonal grooves in the peripheral surface of said washer, whereby the injection passage in said tip is communicated with the nozzle of said nozzle element by said grooves.

* * * * *

UNITED STATES PATENT AND TRADEMARK OFFICE

CERTIFICATE OF CORRECTION

PATENT NO. : 4,427,156

DATED : January 24, 1984

INVENTOR(S) : Pierre Bouthors et al

It is certified that error appears in the above-identified patent and that said Letters Patent is hereby corrected as shown below:

On the title page Inventors should read

--[75] Pierre Bouthors, Croissy sur Seine; Jacques Lecomte, Montesson; Antonio Moretti, Bonnelles all of FRANCE --

Signed and Sealed this

*Fifth* Day of *June 1984*

[SEAL]

*Attest:*

GERALD J. MOSSINGHOFF

*Attesting Officer*

*Commissioner of Patents and Trademarks*